US006575774B2

(12) United States Patent
Ling et al.

(10) Patent No.: US 6,575,774 B2
(45) Date of Patent: Jun. 10, 2003

(54) POWER CONNECTOR FOR HIGH CURRENT, LOW INDUCTANCE APPLICATIONS

(75) Inventors: Yun Ling, Portland, OR (US); Daniel Tong, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/881,680

(22) Filed: Jun. 18, 2001

(65) Prior Publication Data

US 2002/0192989 A1 Dec. 19, 2002

(51) Int. Cl.[7] ..... H01R 4/66

(52) U.S. Cl. ..... 439/108; 439/608; 439/101; 439/607; 439/637; 439/862

(58) Field of Search ..... 439/108, 609, 439/862, 636, 101, 637, 607, 856, 857, 608

(56) References Cited

U.S. PATENT DOCUMENTS 5,618,187 A * 4/1997 Goto ..... 439/79

6,129,555 A * 10/2000 Daikuhara et al. ..... 439/60

* cited by examiner

*Primary Examiner*—P. Austin Bradley
*Assistant Examiner*—Phuongchi Nguyen
(74) *Attorney, Agent, or Firm*—Antonelli, Terry, Stout & Kraus, LLP

(57) ABSTRACT

A connector capable of handling high current, for example, from a voltage regulator module. The connector includes a housing and a plurality of contacts in the housing. The plurality of contacts include power contacts, ground contacts, and signal contacts. The power and ground contacts are arranged in an alternating pattern in the housing. The signal contacts are located at each end of the alternating pattern of power contacts and ground contacts and may be significantly smaller than the power contacts and ground contacts. Each power contact and ground contact include two wide blade-like mating surfaces facing each other but offset and two or more solder tails allowing electrical connection to an electronic circuit. The two mating surfaces and the solder tails comprise a single piece.

17 Claims, 7 Drawing Sheets

POWER CONNECTOR FOR HIGH CURRENT, LOW INDUCTANCE APPLICATIONS

BACKGROUND

1. Field of the Invention

This invention relates to connectors, and more specifically to connectors capable of handling high electric current.

2. Background Information

Electronic cards and modules usually are plugged into a connector that may be located on a motherboard, backpanel, or other printed circuit board (PCB). The connector on the PCB must be able to handle the electric current that flows between the electronic module and the PCB through the connector pins. Certain electronic modules, e.g., power supplies and voltage regulator modules, produce excessively high amounts of current through the connector pins.

FIG. 1 shows a cross-sectional diagram of a currently used voltage regulator module (VRM) connector design. This VRM connector is a modified Industry Standard Architecture (ISA) connector. The cross-section includes two individual contacts 12. Each contact is stamped and formed with one mating interface. Each contact is cold stacked in housing 10 at a 0.1" pitch. Contacts 12 must rely on the housing to hold themselves. When the connector is at high temperature, as a result of high current, the housing material will creep/soften and contacts 12 will lose the support from housing 10. This, combined with the contact material stress relaxation, causes the contact 12 spring loosing normal force, leading to contact interface failure. For this reason, the current carrying capability for this connector is limited to about 3.4 amps per contact. At a given form factor of less than 4", the maximum current that the connector in FIG. 1 can handle is only about 80 amps.

FIG. 2 shows a tuning fork contact design that may be used in a connector. This contact may be used to overcome the problems of the contacts in FIG. 1. With a tuning fork contact, the housing no longer plays any role in generating the contact normal force and, therefore, a key failure mechanism is eliminated. The normal force from VR module insertion is self contained in the contact. However, because of the blanking process limitation in the manufacturing of a tuning fork contact, the contact material thickness must be relatively thin and the small contact cross-sectional area will limit the current carrying capability.

FIG. 3 shows a diagram of another currently used power connector. High current power connectors generally use wide, blade-like contacts, such as the one used in CrownEdge from Tyco-Elcon. The CrownEdge contacts are problematic in that the inductance is relatively high. Moreover, the cost is also relatively high because of the contact design and assembly (i.e., an extra part called the "contact holder" is used in the connector).

Power delivery and management is perhaps the biggest challenge facing some corporations today. Certain server and workstation platforms use voltage regulator modules to supply power to central processing units (CPU). Currently, many voltage regulator connectors can only carry about 80 amperes of current and cannot be used for future designs which may require 100 amperes of current and above. Therefore, there is a need for a connector with contacts for a voltage regulator module that may handle 100 amperes of current within a given specific form factor, and scalable to handle a much higher level.

BRIEF DESCRIPTION OF THE DRAWINGS

The present invention is further described in the detailed description which follows in reference to the noted plurality of drawings by way of non-limiting examples of embodiments of the present invention in which like reference numerals represent similar parts throughout the several views of the drawings and wherein.

DETAILED DESCRIPTION

The particulars shown herein are by way of example and for purposes of illustrative discussion of the embodiments of the present invention. The description taken with the drawings make it apparent to those skilled in the art how the present invention may be embodied in practice.

Reference in the specification to "one embodiment" or "an embodiment"means that a particular feature, structure, or characteristic described in connection with the embodiment is included in at least one embodiment of the invention. The appearances of the phrase "in one embodiment" in various places in the specification are not necessarily all referring to the same embodiment.

The present invention relates to a connector capable of handling high current, for example, from a voltage regulator module (VRM). The connector includes a plurality of contacts that include, power contacts, ground contacts, and may include signal contacts. The power contacts and ground contacts are arranged in an alternating pattern in the connector. Each power contact and ground contact includes two wide blade-like mating surfaces facing each other but offset, as well as two or more solder tails allowing electrical connection to an electric circuit on a motherboard or backpanel or PCB.

Figure 1:
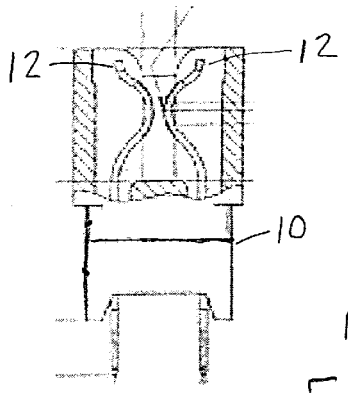
PRIOR ART FIG 1
FIG. 1 is a cross-sectional diagram of a currently used voltage regulator module (VRM) connector design.
Figure 2:
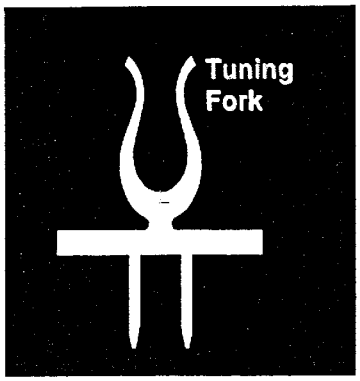
PRIOR ART FIG 2
FIG. 2 is a tuning fork contact design that may be used in a connector.
Figure 3:
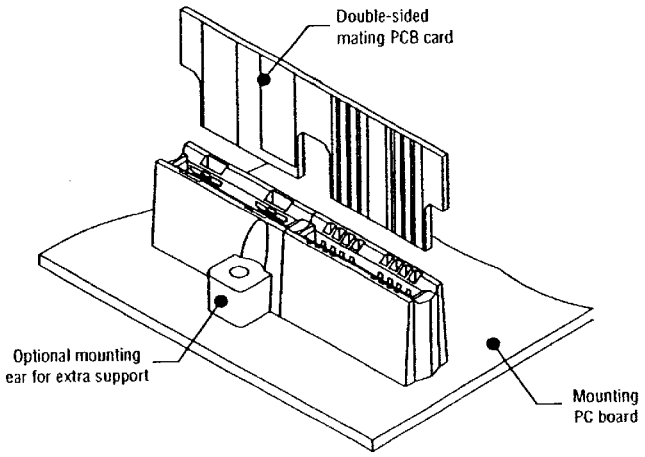
PRIOR ART FIG 3
FIG. 3 is a diagram of another currently used power connector.
Figure 4:
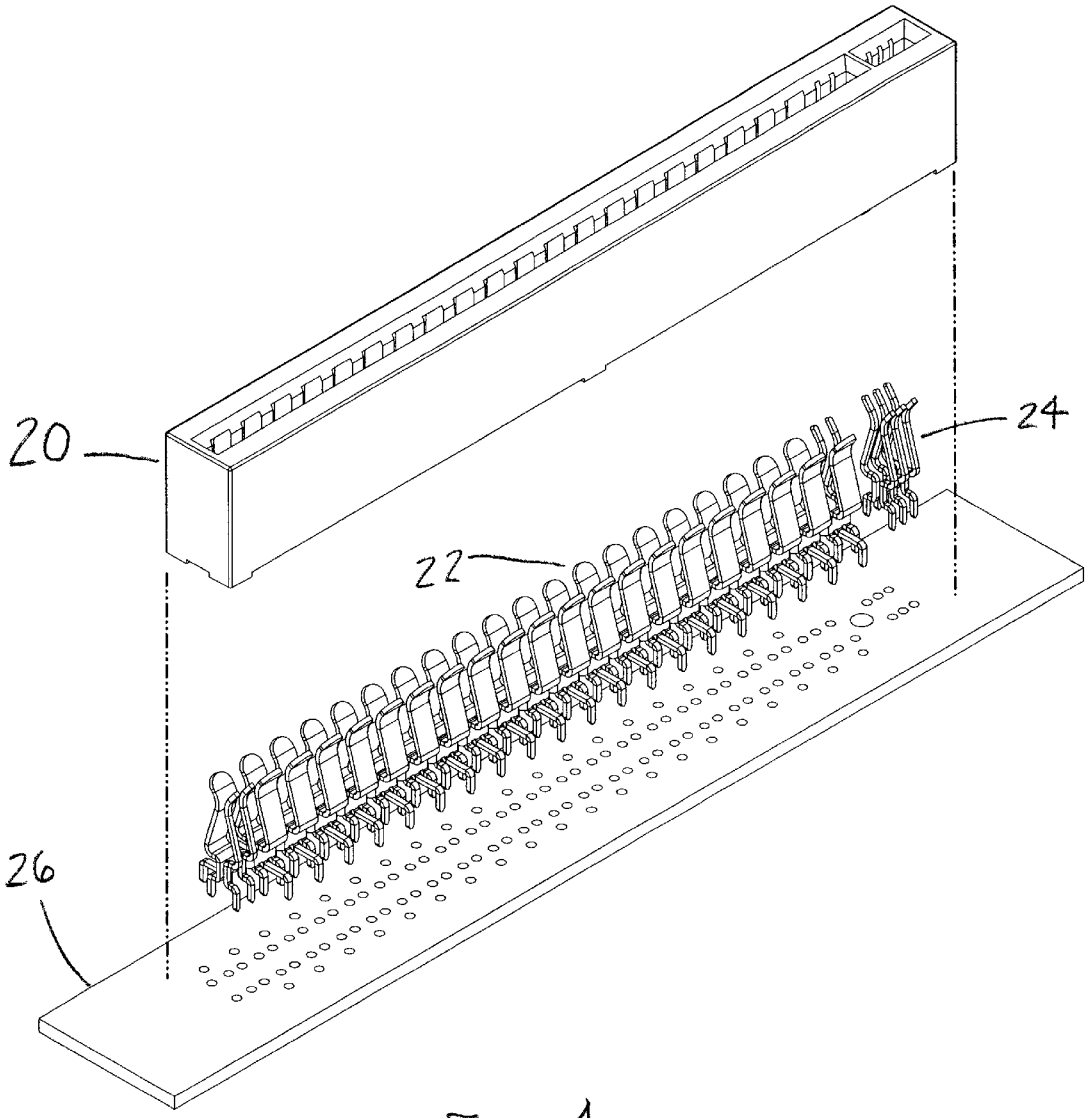
FIG. 4 is a diagram of an unassembled high current connector according to an example embodiment of the present invention.

FIG. 4 shows a diagram of an unassembled high current connector according to an example embodiment of the present invention. The connector includes a housing 20 that houses a plurality of power and ground contacts 22 and signal contacts 24. Once included in housing 20, the connector can be attached to a motherboard 26, backpanel, PCB, or other electronic circuit. As shown in FIG. 4, the signal contacts may be located at the ends of the row of power and ground contacts 22. Further, the signal contacts may be significantly smaller than the power and ground contacts 22 thereby allowing the connector to take up less space. The power and ground contacts are identical in shape and size. The housing may consist of a plastic material, epoxy material, rubber material, or other insulating material. All contacts may be bottom-loaded into housing 20. The retention of each contact in the housing is achieved through an interference fit. The connector may be through-hole mounted to a printed circuit board (PCB), while the voltage regulator or other power module is inserted into the connector slot.

Figure 5:
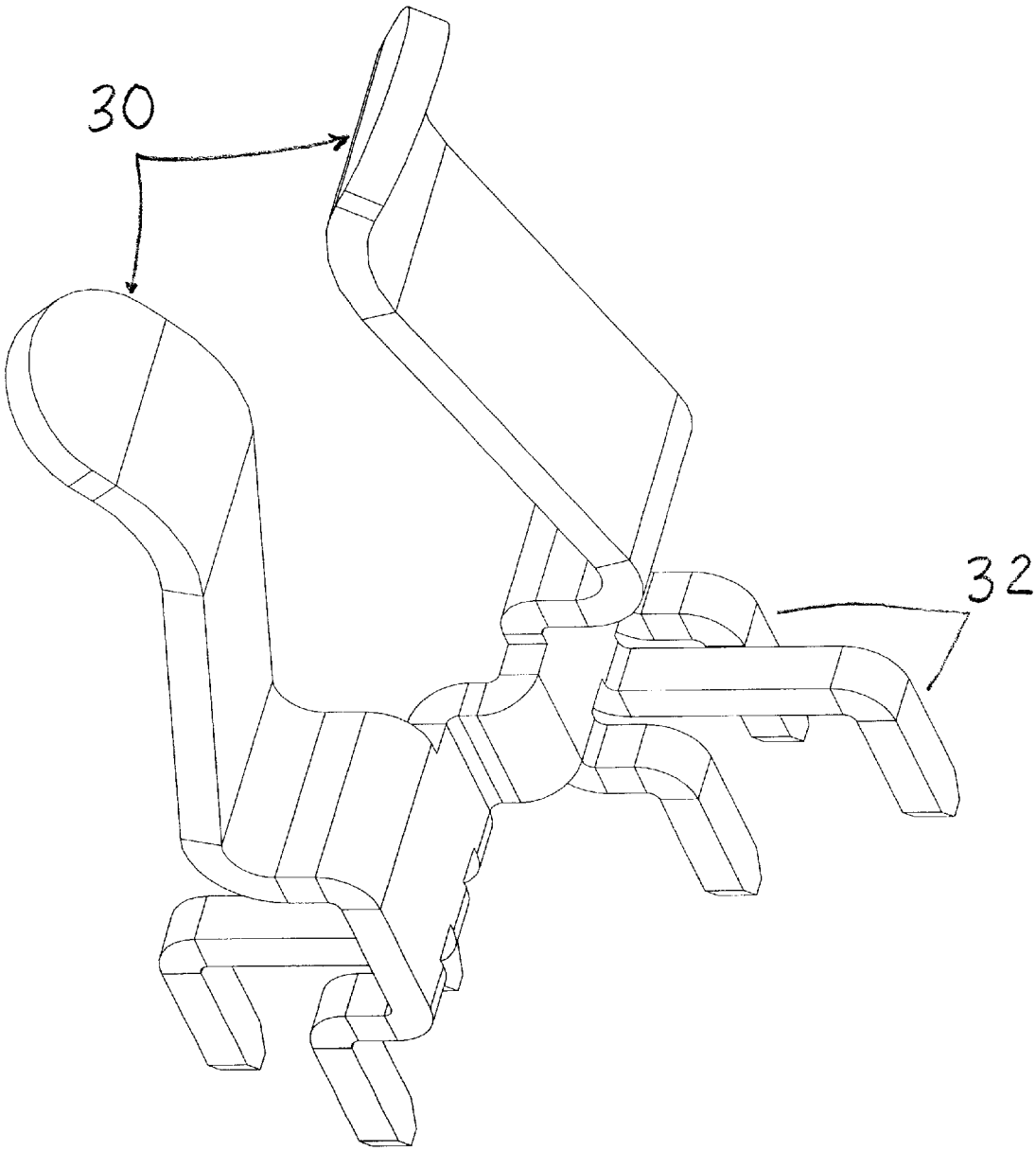
FIG. 5 is a diagram of a power and ground contact according to an example embodiment of the present invention.

FIG. 5 shows a diagram of a power and ground contact according to an example embodiment of the present invention. The power/ground contact 22 shown in FIG. 5 may be made of a high conductivity copper alloy. This contact may be stamped and formed with two mating surfaces 30 that may be engaged on opposite sides of pins of a voltage regulator or other power module. The wide, blade-like contact of each mating surface ensures low contact electrical and thermal resistances. Each power/ground contact 22 may be press-fit or soldered to a motherboard through two or more press-fit or solder tails 32. In the example embodiment shown in FIG. 5, there are six solder tails, however, one or more solder tails may exist on a contact and still be within the spirit and scope of the present invention. The multiple solder tails 32 allow the easy flow of electrical current to and from a motherboard and greatly enhance the heat conduction or dissipation from the connector to the motherboard. The size of the contacts may be determined by the desired current carrying capacity of the contact. Further, the number of solder tails may be determined by the size of the contact.

Figure 6:
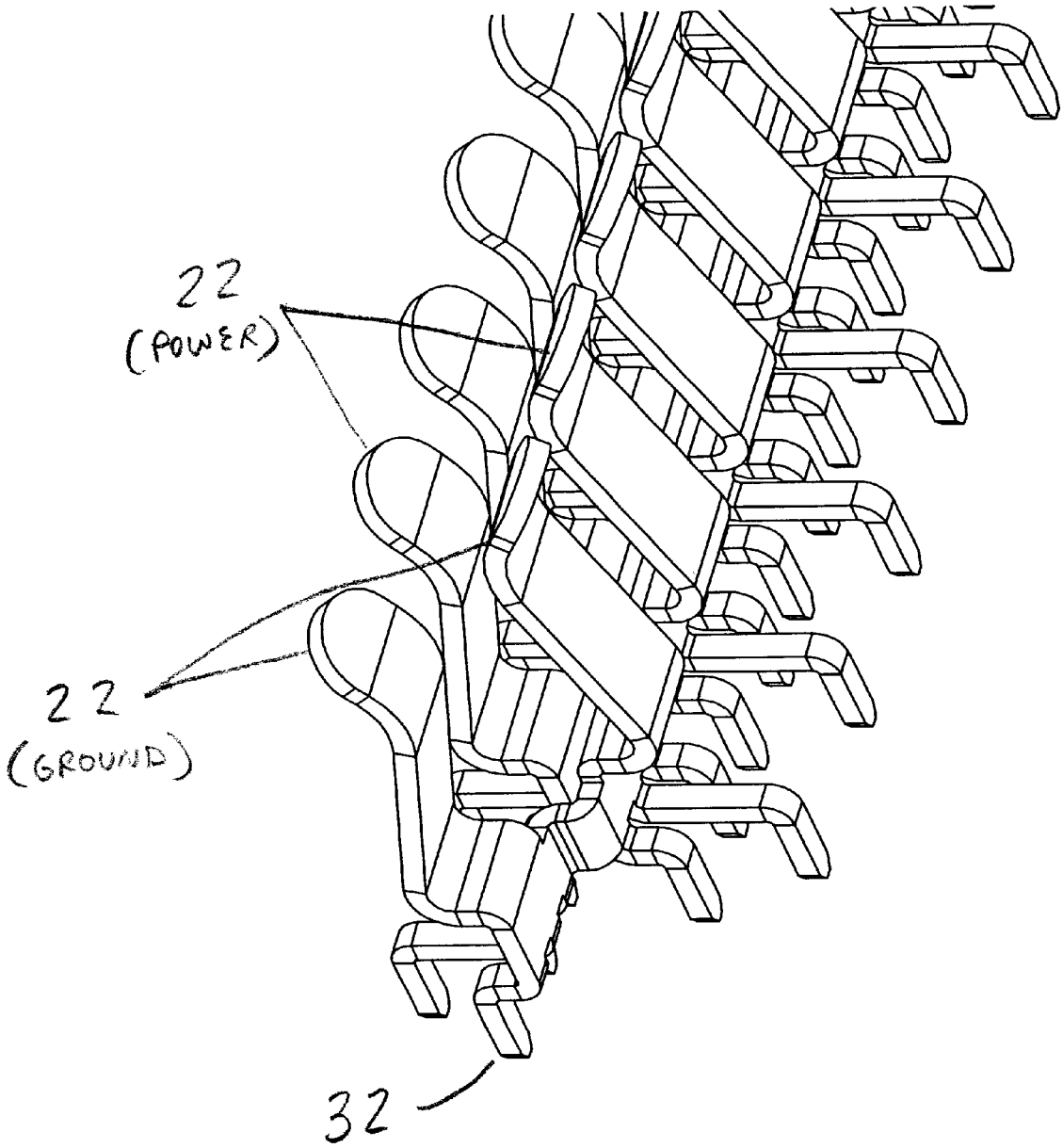
FIG. 6 is a diagram of an alternating pattern of power and ground pins according to an example embodiment of the present invention.

FIG. 6 shows a diagram of an alternating pattern of power and ground pins according to an example embodiment of the present invention. The power and ground pins may be arranged in an alternating pattern. The close proximity of the power contacts to the ground contacts (in the alternating arrangement) allows for low loop inductance. The signal contacts may be much smaller than the power/ground contacts and may be placed together with a smaller pitch (e.g., 1 mm.) to save room on the motherboard.

Figure 7:
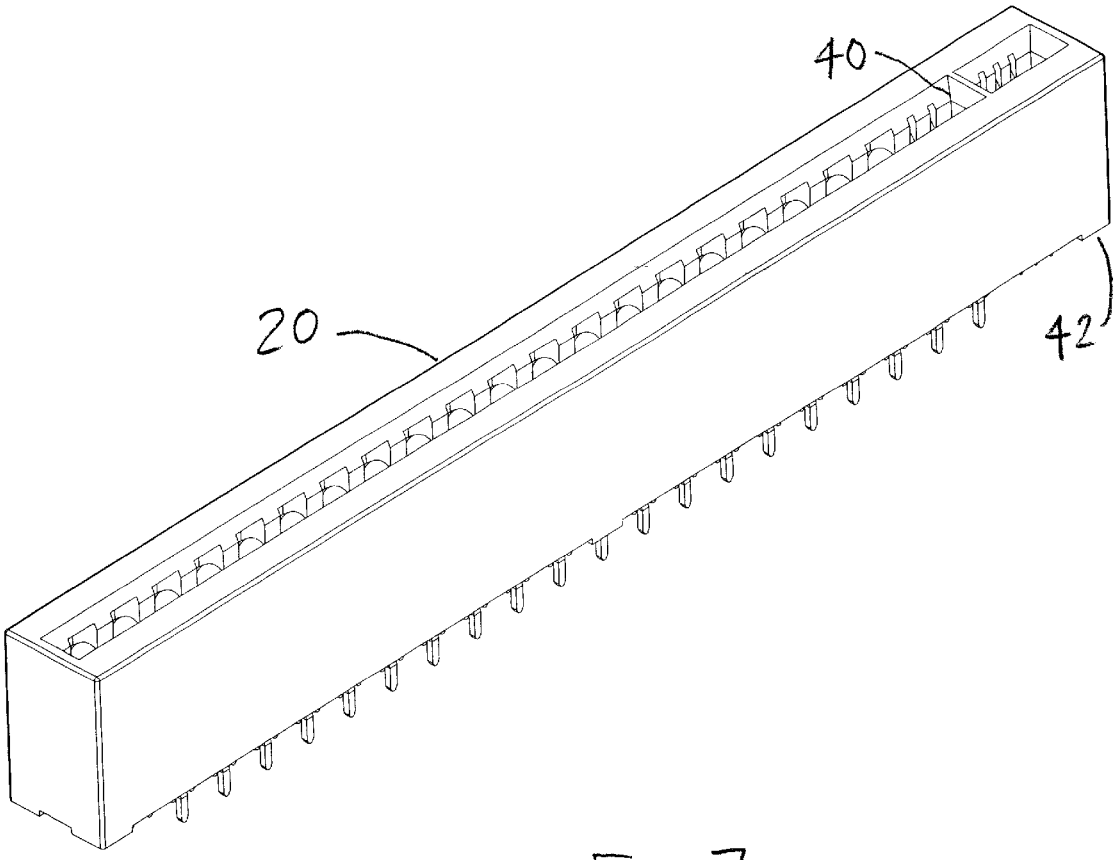
FIG. 7 is a diagram of a housing according to an example embodiment of the present invention.
Figure 8:
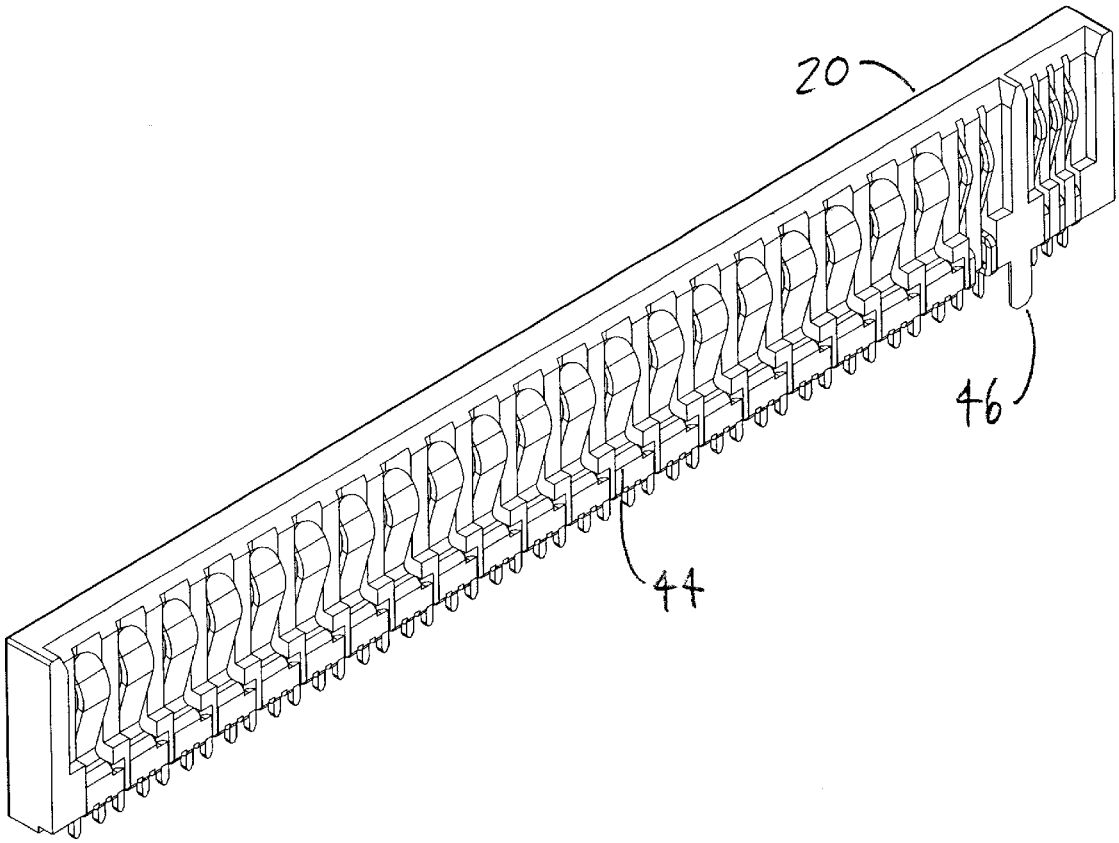
FIG. 8 is a diagram of a housing cut in half according to an example embodiment of the present invention.

FIGS. 7 and 8 show diagrams of a housing and housing cut in half respectively, according to an example embodiment of the present invention. All contacts, including power, ground, and signal, are inserted into housing 20. Housing 20 may include a key 40 to prevent plugging the voltage regulator module into the connector the wrong way. Further, housing 20 may include a standoff 42 that allows for cleaning after soldering. Slots 44 on the bottom of housing 20 allow acceptance and retaining of the contacts through an interference fit. A positioning post 46 may exist on housing 20 for polarization and easy assembly to a motherboard.

Figure 9:
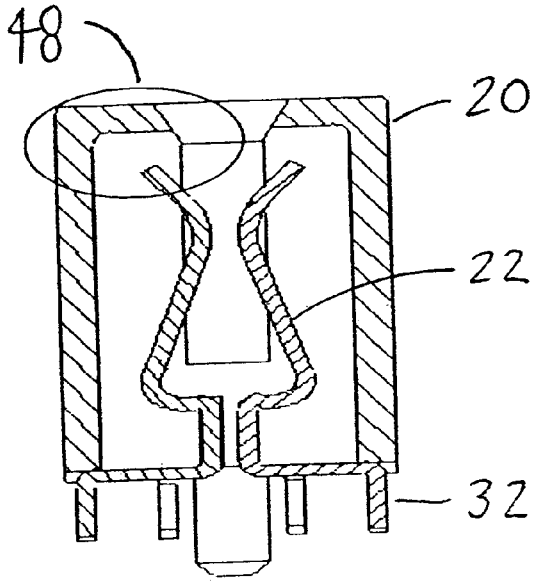
FIG. 9 is a side view diagram of a connector according to an example embodiment of the present invention.

FIG. 9 shows a side view of a connector according to an example embodiment of the present invention. A wall 48 at the top of housing 20 may exist to protect contact 22. The tips of contact 22 hide below the top of housing wall 48, therefore, eliminating the chance of contact 22 stubbing or buckling or being collapsed from insertion of a voltage regulator module.

With a properly selected contact material, each power and ground contact may be about 0.27" wide, for example, together with six solder tails on each contact to deliver very high current carrying capability, for example between 15–20 amperes of current. A 4" length connector, for example, may include room for 10 pairs of power and ground contacts as well as 10 signal pins. Therefore, a connector according to the present invention of 4" long may easily carry 150 amps of current and allow ample scalability for future power delivery needs.

Connectors and contacts according to the present invention are advantageous in that they allow a wide, blade-like contact to be used with the maximum cross-sectional area to reduce the thermal and electrical resistances. Moreover, the housing impact on contact normal force is eliminated, i.e., the creep of the housing material under high temperature does not degrade the connector's current carrying capability. Moreover, power and ground contacts may be placed in an alternating pattern making loop inductance relatively low and the routing of a voltage regulator module easy. In addition, the tips of each contact are protected by the housing wall at the connector top such that the contact is not vulnerable to stubbing or buckling. Moreover, a combination approach with bulky power/ground contacts and small signal contacts allows for the connector taking up less space, and thus more efficient use of room on the motherboard. Further, the connector allows the use of low cost stamped and formed contacts with very little material scrap. Power and ground contacts can be simply tin plated since they are high normal force contacts.

It is noted that the foregoing examples have been provided merely for the purpose of explanation and are in no way to be construed as limiting of the present invention. While the present invention has been described with reference to a preferred embodiment, it is understood that the words that have been used herein are words of description and illustration, rather than words of limitation. Changes may be made within the purview of the appended claims, as presently stated and as amended, without departing from the scope and spirit of the present invention in its aspects. Although the present invention has been described herein with reference to particular methods, materials, and embodiments, the present invention is not intended to be limited to the particulars disclosed herein, rather, the present invention extends to all functionally equivalent structures, methods and uses, such as are within the scope of the appended claims.

What is claimed is:

1. A connector capable of handling high current comprising:

a housing; and a plurality of contacts in the housing, the plurality of contacts comprising power contacts and ground contacts, the power and ground contacts arranged in an alternating pattern, each power contact and ground contact comprising:

two blade-like mating surfaces facing each other in an off-center alignment; and at least two solder tails allowing electrical connection to an electronic circuit, wherein the mating surfaces and the at least two solder tails comprise a single piece.

2. The connector according to claim 1, wherein the plurality of contacts are arranged in a row in the housing.

3. The connector according to claim 1, wherein the two blade-like mating surfaces facing each other in an off-center alignment with space between them.

4. The connector according to claim 1, comprising at least two solder tails under each mating surface.

5. The connector according to claim 1, wherein each power contact and ground contact are bottom-loaded into the housing.

6. The connector according to claim 1, wherein each power contact and ground contact are retained in the housing through interference fit.

7. The connector according to claim 1, wherein the power contacts and the ground contacts are located in close proximity to each other allowing low loop inductance.

8. The connector according to claim 1, further comprising a wall at the top of the housing, the wall protecting the tips of each power and ground contact thereby preventing each power contact and ground contact from stubbing and buckling.

9. The connector according to claim 1, further comprising signal contacts, the signal contacts being located at each end of the alternating pattern of power contacts and ground contacts.

10. The connector according to claim 9, where the signal contacts are significantly smaller than the power contacts and ground contacts.

11. A voltage regulator module (VRM) connector comprising:

a housing; and a plurality of contacts in the housing, the plurality of contacts comprising power contacts, ground contacts, and signal contacts, the power and ground contacts arranged in an alternating pattern, the signal contacts being located at each end of the alternating pattern of power contacts and ground contacts, each power contact and ground contact comprising:

two wide blade-like mating surfaces facing each other in an off-center alignment; and at least two solder tails allowing electrical connection to an electronic circuit, wherein the mating surfaces and the at least two solder tails comprise a single piece.

12. The connector according to claim 11, where the signal contacts are significantly smaller than the power contacts and ground contacts.

13. The connector according to claim 11, comprising at least two solder tails under each mating surface.

14. The connector according to claim 11, wherein the two blade-like mating surfaces facing each other in an off-center alignment with space between them.

15. The connector according to claim 11, wherein the power contacts and the ground contacts are located in close proximity to each other allowing low loop inductance.

16. The connector according to claim 11, further comprising a wall at the top of the housing, the wall protecting the tips of each power and ground contact thereby preventing each power contact and ground contact from stubbing and buckling.

17. The connector according to claim 11, wherein each power contact and ground contact is approximately 0.27" wide and capable of handling approximately 15 amperes to 20 amperes of current.

* * * * *